US005215709A

United States Patent [19]

Bennati

[11] Patent Number: 5,215,709

[45] Date of Patent: Jun. 1, 1993

[54] METHOD AND DEVICE FOR TREATMENT OF METAL BATHS BY MEANS OF A MATERIAL HAVING A HIGH GAS VAPOR POTENTIAL

[75] Inventor: Ettore Bennati, Corte Franca, France

[73] Assignee: Tubi Ghisa S.p.A., Genova, Italy

[21] Appl. No.: 863,711

[22] Filed: Apr. 3, 1992

[30] Foreign Application Priority Data

Apr. 5, 1991 [IT] Italy ..... BS91 A 000038

[51] Int. Cl.[5] ..... C22C 33/10

[52] U.S. Cl. ..... 420/19

[58] Field of Search ..... 420/19, 20, 21; 266/216

[56] References Cited

U.S. PATENT DOCUMENTS

| | | | |
|---|---|---|---|
| 3,666,449 | 5/1972 | Alt | 420/20 |
| 3,802,680 | 4/1974 | Anders et al. . | |
| 4,496,393 | 1/1985 | Lustenberger | 420/21 |

FOREIGN PATENT DOCUMENTS

| | | |
|---|---|---|
| 1254166 | 11/1967 | Fed. Rep. of Germany . |
| 1275556 | 8/1968 | Fed. Rep. of Germany . |
| 1433639 | 11/1968 | Fed. Rep. of Germany . |
| 1758110 | 12/1970 | Fed. Rep. of Germany . |
| 1939246 | 2/1971 | Fed. Rep. of Germany . |
| 2132233 | 11/1972 | France . |
| 1040266 | 8/1966 | United Kingdom . |
| 1503226 | 3/1978 | United Kingdom . |

*Primary Examiner*—Peter D. Rosenberg
*Attorney, Agent, or Firm*—Oliff & Berridge

[57] ABSTRACT

Device and method for treatment of metallic baths by means of at least one treating material having high potential for development of gases or vapours when heated by the metallic bath, comprising a ladle having a pouring spout and a closing lid. In the ladle's bottom is formed a closed chamber, to be enclosed by the metallic bath when poured into the ladle, for receiving the treatment material and holding the vapours or gases which develope. The chamber is provided with at least one release conduit rising to end within the ladle, the release conduit being closed by a plug to provide a controlled opening.

14 Claims, 3 Drawing Sheets

METHOD AND DEVICE FOR TREATMENT OF METAL BATHS BY MEANS OF A MATERIAL HAVING A HIGH GAS VAPOR POTENTIAL

BACKGROUND OF THE INVENTION

1. Field of the Invention

The present invention refers to a method for treatment of metal baths, i.e. molten metals, by means of materials having a high capability of developping gas or vapour when heated by the molten metal. The invention also refers to a device for the realization of such method.

More particularly, the invention is utilized for the spheroidizing treatment of pig iron, i.e. for the production of spheroidal pig iron by means of to a device for the realization of such method.

More particularly, the invention is utilized for the spheroidizing treatment of pig iron, i.e. for the production of spheroidal pig iron by means of materials apt to spheroidize the graphite contained in the molten iron, such materials usually comprising pure magnesium, magnesium alloys and/or other additives such as calcium, cerium or other rare earth element, and being hereinafter referred to as treatment or spheroidizing material.

2. Discussion of Related Art

For such a treatment of metallic baths, and particularly for the production of spheroidized iron, many methods have already been proposed, such as those characterized by the type of ladle or vessel used, by the placing of the treating material in the ladle, by the timing of contact between treating material and metallic bath, and by using a fixed or a rotating ladle.

Correspondingly, spheroidizing methods are known in open or closed ladles, under a pressure or in pressurized chamber, with the spheroidizing material placed on the ladle's bottom, in a little pit or under a diaphragm or a layer of steel pieces, or immersed in the metal bath using a number of methods, and brought into contact with the metallic bath by tilting the ladle.

The main problem to be confronted with in the sphroidizing treatment of graphite in the pig iron has always been mastering of the quick and violent development of gas or vapour by the treatment material when heated in contact with the metallic bath and keeping and distributing, as long and as much as possible, such gas or vapour within the bulk of molten metal in order to obtain a uniform treatment. Many attempts have been made also in this sense, particularly using closed ladles and devices to send or bring the treating material within the metal bulk.

In any case the treating material when in contact with the fused metal bath always vapourized with a violent and uncontrollable emission of gas or vapours and sparkles.

SUMMARY OF THE INVENTION

The present invention aims to solve this problem in a new and original way, utilizing a method and a device which, on one hand permits the use of any spheroidizing material and, on the other hand permits the spheroidizing material to vapourize without direct contact with the molten metal, but upon indirect heating by means of the latter. This condition permits a better control of the reaction and the reacting, with respect to other methods, and provider such advantages as: a better yield of the reacting (treating) material; less temperature drops; quick reaction (treatment); more uniform distribution of the treating gases; higher purity of treated materials; evolution of reaction products in a confined area, without fumes and sparkles; utilization of a same ladle both for spheroidizing treatment and for casting of metal; high used ductility of the device; high automation level; and low and simple servicing.

The invention is mainly based upon entrapment of an air volume in a gap or reaction chamber placed on the bottom of a ladle and to be defined in the bulk of molten metal, poured in the ladle, upon forcing the gases or vapours produced by the treatment material to develop and collect in such a chamber and upon letting such gases or vapours flow within the metallic bath, only when the latter reaches a given level in the ladle, and when a given pressure difference is established between the pressure of such gases or vapours in said chamber and the metallostatic pressure in the ladle.

The method according to the invention, through realizable with a static ladle, is undoubtely favoured by the use of a rotatable ladle, which lets the treating material to collect in the reaction chamber by centrifugal force and to develop in the same chamber the treating vapours upon heating by the molten metal.

DESCRIPTION OF THE DRAWINGS

More details of the invention shall be evident from the following description, with reference to the enclosed drawings in which.

DESCRIPTION AT PREFERED EMBODIMENT

According to the invention, the method of treatment of a metallic bath 11, particularly molten pig iron, by means of a treating material 12 having a high gas or vapour potential, particularly by means of a spheroidizing material for iron, such as magnesium, magnesium alloys and the like, with or without additives, involves melting and vaporising of the treating material in a closed chamber 13 within the metallic bath 11 and without direct contact between treating material and the metallic bath, maintaining the treating gas or vapour in chamber 13 at least until the metallic bath 11 reaches a given level above chamber 13 and letting said chamber 13 communicate with the metallic bath 11 for the distribution of the treating gases or vapours in sard metallic bath. The method can be put into practice using a static or preferably rotatable treating ladle 14.

Figure 1:
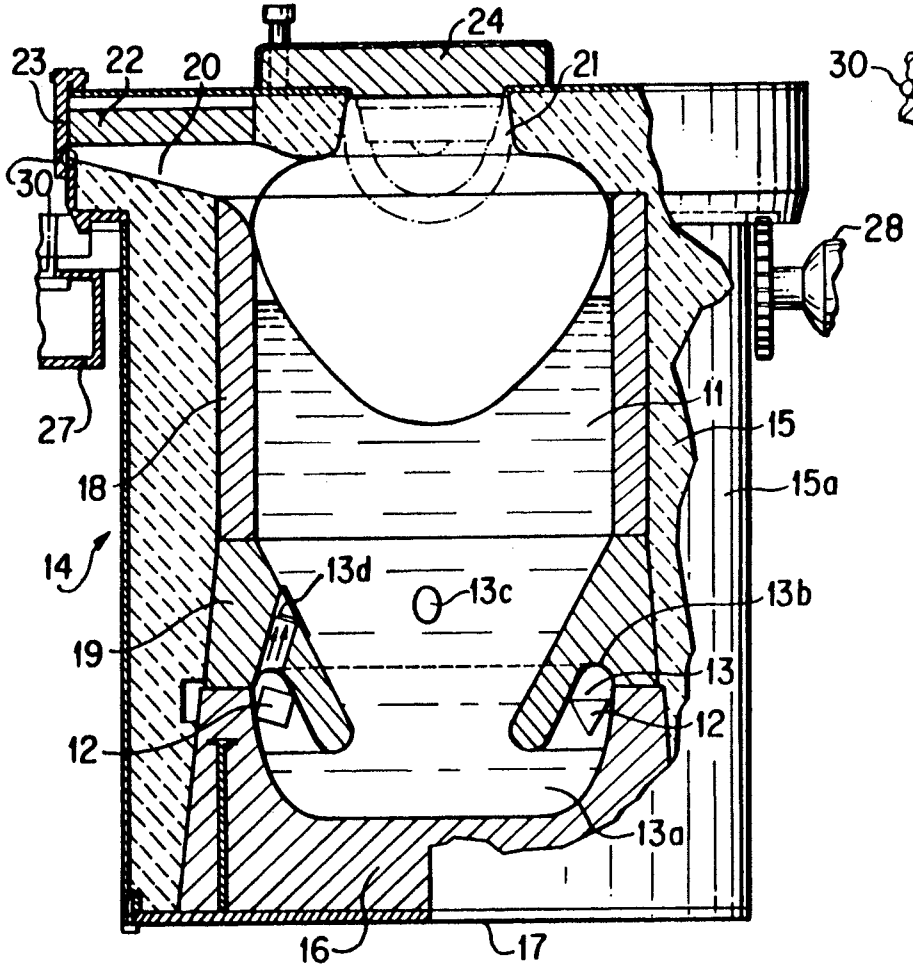
FIG. 1 shows a schematic vertical section of a rotating ladle.

An embodiment of ladle 14 is shown in FIG. 1, and comprises a refractory body 15 enclosed in an outer jacket 15*a* and provided with a bottom refractory element 16, supported by a removeable plate 17. Within the ladle 14 are an interchangeable head insert 18 and an interchangeable middle insert 19 between the head insert 18 and the bottom 17.

In the upper part, the ladle 14 has a pouring spout 20 and, in central position, a porthole 21 to change, in different times, the treating material 12 and the metallic bath 11. The pouring spout 20 is under an intercheangeable brick 22 and is provide with a security closing element 23, which closes the spout by gravity or by centrifugal force. The charging porthole 21 is provided with a refractory lid 24, rotatable around an axis 25—see also FIGS. 2 and 3—between an open position and a closed sealing position of porthole 21, the lid 24 having a charging hole 26 which comes in correspondence with the charging porthole 21 when the lid 24 is in the open position.

The ladle 14 can be fixed, or preferably rotatable in a fixed direction or in reciprocal direction, to impart to the ladle's 14 content a centrifugal force as well as mixing movements. In this latter case, the ladle 14 is mounted in rotatable way a supporting frame 27 and is moved by a motorized reversing apparatus 28, as shown in FIG. 1 in exemplificatory way. The opening/closing movement of lid 24 can be manual, or preferably semi-automatic, and/or actuated in dependence of the rotation and stopping of the ladle 14, when the ladle 14 is rotatable.

Figure 4:
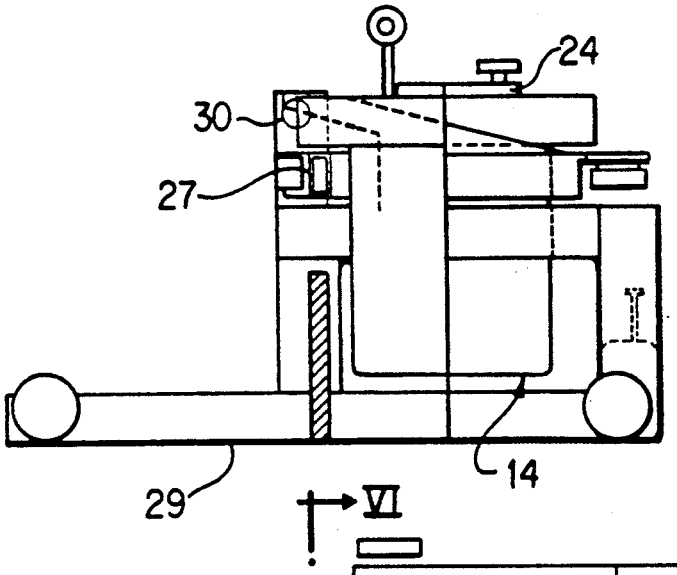
FIG. 4 shows a lateral view of the ladle on a trolley structure.
Figure 5:
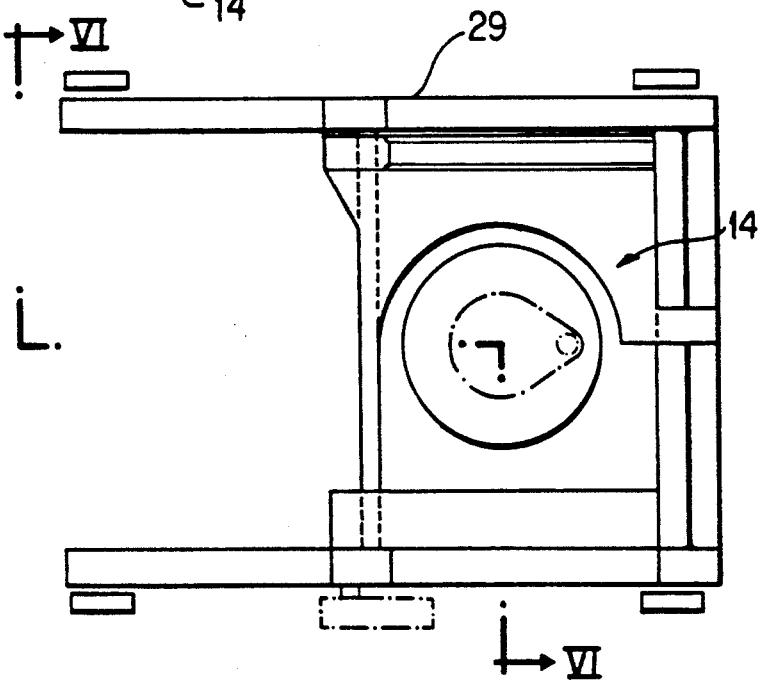
FIG. 5 shows a plan view of the ladle with a trolley of FIG. 4.
Figure 6:
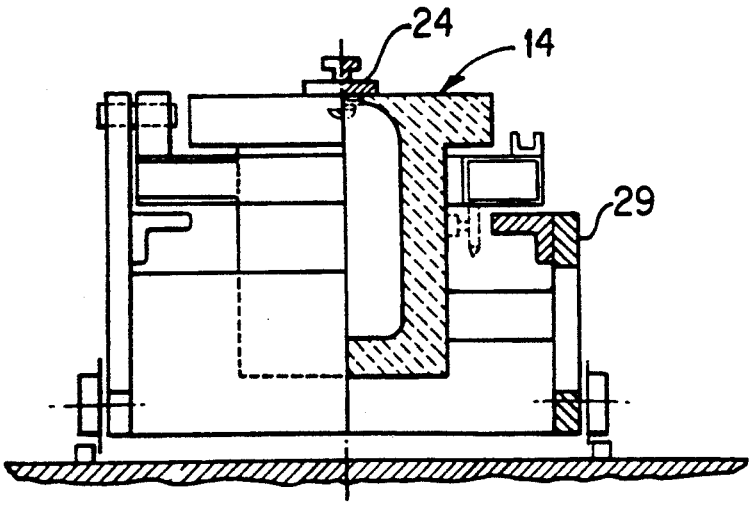
FIG. 6 shows a view in partial section according to arows VI—VI in FIG. 5.

The ladle 14, either fixed or rotatable, is preferably mounted in a trolley structure 29—see FIGS. 4,5 and 6—for easy transport from one place to another one, having its use. The ladle 14 can also be inclined by rotation around an orizontal axis 30 placed at the level of pouring spout 20, to pour or transfer the metallic bath after the treatment.

The closed chamber 13, in which the treating gases or vapours are generated, is formed in the ladle 14 between the bottom element 16 and the middle insert 19. To this end, element 16 and insert 19 are thus conformed to define, in cooperation, an annular chamber rising from the bottom, such as to present an entrance 13*a* at a lower level with respect with the ceiling 13*b* of the chamber itself. In the embodiment shown in FIG. 1, the entrance 13*a* opens towards the ladle's 14 axis at the bottom level and the chamber rises with an arched slope towards the outer part of the ladle. From the ceiling 13*b* of the chamber 13 one, two or more release conduits 13*c* rise to end within the ladle 14 above said chamber 13 and, at a given level above the bottom of the ladle. The release conduits 13*c* are closed and remain closed by plugs 13*d* during the development of treating gases or vapours in said chamber 13, the plugs being removed, i.e. being expelled or melted only when the metallic bath in the ladle covers the terminal part of the conduits 13*c*. The plugs are produced with materials compatible with the metallurgical process.

A description of a cycle for the production of spheroidal iron, using a ladle 14 as described above, rotatable and with a trolley 29 for its movements, now follow.

The ladle 14 is first placed under the pouring spout of a fusion furnace, its lid 24 being open. Then, rotation of the ladle 14 is started, on the supporting frame 27 by means of the motor apparatus 28, and the spheroidizing material 12 and/or other additives are charged within the ladle, through the charging part of the lid 24, coinciding with the mouth of the ladle 14.

Figure 2:
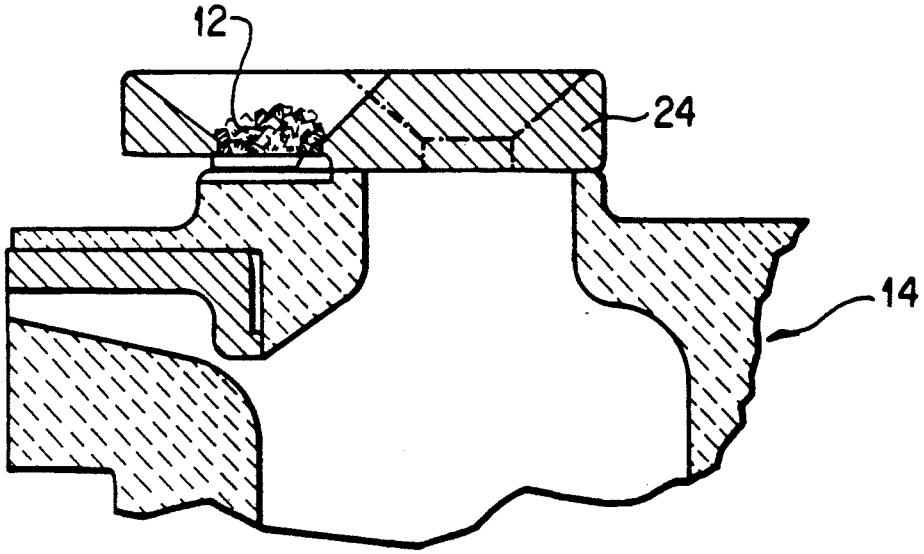
FIG. 2 shows a detail of the ladle's lid with the treating material ready to be automatically introduced into the ladle.
Figure 3:
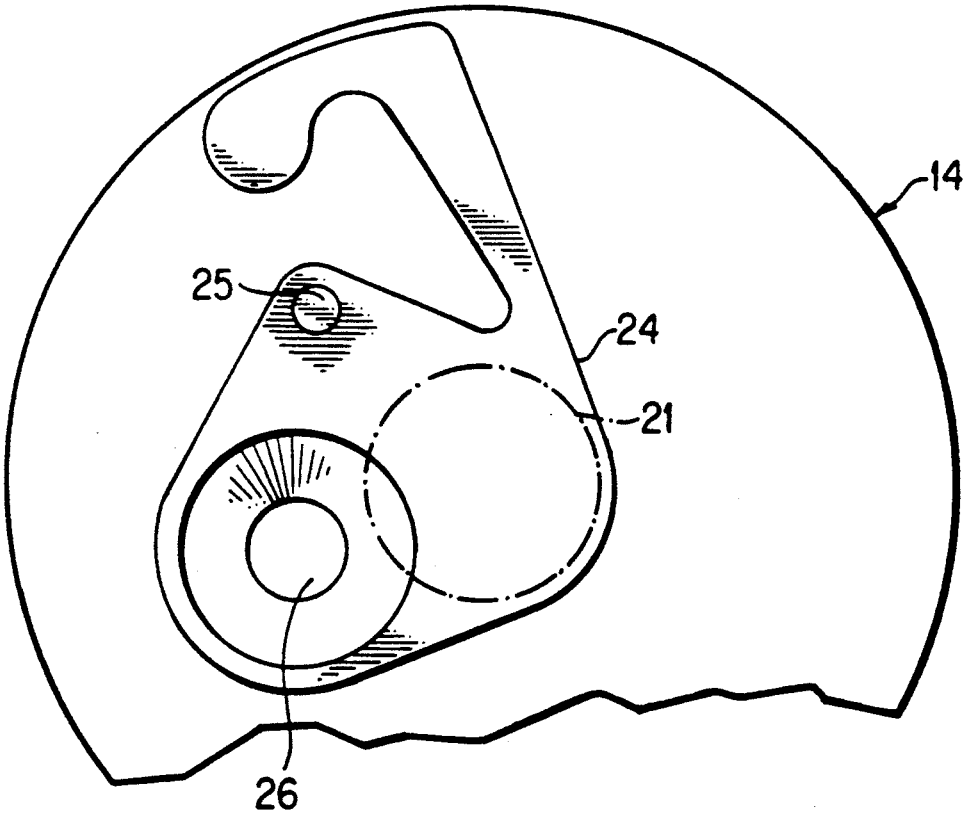
FIG. 3 shows top plan view of the lid on the ladle.

Alternatively, as shown in FIG. 2, the treating material can be placed on the lid 24, for instance in the charging hole 26, such as when the lid is opened, the material falls by gravity in the ladle, without any external help.

As the spheroidizing material either magnesium alloys or pure magnesium; can be used as additives, desulphurizing, inoculating, carburating agents or any other material, necessary to the metallurgy can be introduced.

It is to be noted that to retard the beginning of reaction of such materials, particularly the spheroidizing one, the same can be protected by coatings or superficially cooled.

In any case, thanks to the ladle's 14 rotation, such materials, or at least the spheroidizing one 12, are conveyed by centrifugal force to within the treating chamber 13—FIG. 1. At that time release conduits 13*c* are closed.

Within a minimum time gap from the introduction of said materials, the molten metal 11 to be treated is then introduced, through the coinciding charging hole 26 and charging pasthole 21.

The quantity of molten metal shall be precisely determined, in a way well known to the experts, to avoid spilling of the same as the ladle rotates.

To this aim security means can be provided such as, load cells on the centrifugating frame, current absorption means for the rotating motor; and a limitation of the rotating speed of the motor. Means shall stop the rotation of the ladle 14 and signal the anomaly when given values are exceeded.

When the charge is completed, lid 24 of ladle 14 is moved and blocked in closed position and the ladle 14 operated to rotate at treatment speed and with reciprocating movement.

When the metallic bath is charged in the ladle, the spheroidizing material 12 is heated and quickly evaporates, although not in direct contact with the molten metal. The thus formed gases or vapours are collected and maintained in chamber 13, since the entrance 13*a* of chamber is closed by the molten metal and the release conduits 13*c* are closed by relevant plugs 13*d*.

In other words, the spheroidizing material 12 is heated by radiation of molten metal 11, and the gases or vapours formed remain within the chamber 13 progressively rising their pressure, which prevents the entrance, from the bottom, of the molten metal 11 into the chamber 13.

The pressure of gases or vapours within the chamber 13 is in relation with the metallostatic pressure and hence the level of the liquid bath in the ladle 14 above the plugs 13*d* closing the release conduits 13*c*. When the pressure within the chamber 13 is higher than the external pressure, the gases or vapours can expel the plugs 13*d* from said release conduits 13*c*, to admit the gases or vapours within the metallic mass 11 to be treated. Said release conduits 13*c* could also be opened, when needed, by appropriate mechanical removal means or by melting of the plugs 13*d*. In any case, once the conduits are opened, the treating gases or vapours will uniformly distributed within the molten metal with the help of the movements of the metal bath in the ladle 14 that is reciprocably rotated.

The speed at which the gases or vapours disperse from the chamber 13 into the metallic bath 11, i.e. the speed of the spheroidizing process, will depend on the pressure in the chamber 13 and on the free section of the release conduits 13*c*, which parametres can be easily managed to optimize the treatment also on the basis of treated metal and of the level of metal 11 in the ladle.

As an additional bonus, the ladle's rotation furthers the separation of the reaction slags and their accumulation at the apex of the rotation paraboloid which forms as the bath rotates. The closed lid 24 and pouring spout 20 of the ladle 14 prevent any dispersion of the treating gases or vapours which thus can be rationally and intensively used.

Once the treatment time has lapsed, the ladle's 14 rotation is stopped and the pouring spout 20 of the latter is placed in correspondance with the casting place for the treated metal. Then the lid 24 is open to perform, as the bath still invertially rotates, the slugging operation, with the help of an aspirating system of the floating slag or of conventional means. Then, the lid 24 shut again, and the metal 11 treated in the ladle 14 can be directly cast in a mould or poured in other ladles or casting devices.

As the ladle 14 is empted and the residual slags eliminated, the plant can be brought back to the initial conditions to start a new cycle. The advantages deriving from such a treating mode are self-evident and some have already pointed out. To those advantages can be added a simple, quick and safe introduction of the additives; no need to use other covering or anchoring materials of the treating material; excellent separation and easy removal of the slags; easy cleaning and maintenance of the ladle; high productive ductility of the system both for quantity and for quality.

Figure 7:
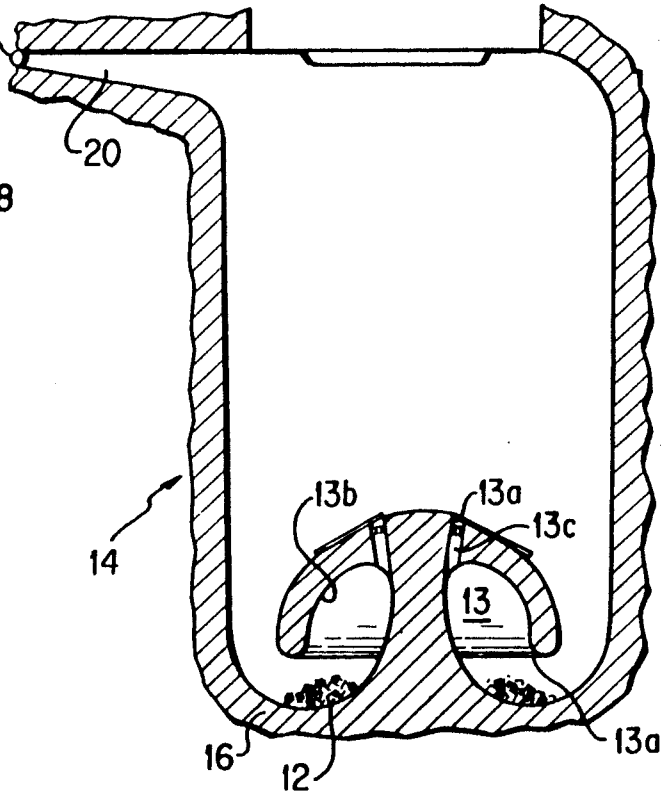
FIG. 7 shows, in section, another embodiment of the ladle's bottom.

The above described device can be subjected to a number of structural and minor modifications without evading the aim of protection of the invention. Thus, for instance, the annular chamber under the metallic bath can have a lower entrance opening towards the outer part of the ladle, while the chamber itself raises from the bottom towards the center of the ladle as shown in FIG. 7, that is in a way opposite to the one shown in FIG. 1, even if in this case the introduction of the treatment material does not require the ladle's rotation.

Finally it is to be noted that the same method and the same treating device can be utilized also in other processes, than the ones concerning the production of spheroidal iron, for treatment both of molten metals and of liquids.

I claim:

1. A method for treatment of a metallic bath by means of at least one treating material having a capability to generate gases or vapors when heated by the metallic bath, comprising the steps of:

melting/vaporization of the treatment material in a chamber, enclosed in the metallic bath, by heating without direct contact between the treating material and the metallic bath;

maintaining and pressurizing the vapors or gases developed from the treating material in said chamber during the vaporization of the treating material; and communicating the chamber with the metallic bath once the metallic bath has reached a given level above the chamber in order to distribute the gases or vapors from the treating material into the metallic bath for the treatment of the metallic bath.

2. The method according to claim 1, wherein the vapors or gases developed by the treating material pass from said chamber to the metallic bath through conduits opening after the metallic bath is poured.

3. The method according to claim 1, wherein the vapors or gases developed by the treating material are collected in said chamber and are distributed from the latter while the metallic bath is rotated in a single or reciprocal direction and the reaction vessel is kept closed.

4. The method according to claim 1, executed in a rotatable ladle provided with a closure lid, further comprising the steps of:

introducing the treatment material when the lid is open;

rotating the rotatable ladle;

distributing the treatment material by action of centrifugal force to the chamber positioned in a bottom portion of said ladle, said chamber having a closed ceiling provided with at least one release conduit rising to end within the ladle and kept closed by a plug;

introducing the metallic bath into the ladle to thereby vaporize the treating material;

collecting and keeping under pressure said gases or vapors in said chamber until the metallic bath exceeds at least the level of said at least one release conduit of the chamber;

closing the ladle's lid;

removing the plug from said release conduit for admitting and distributing the gases or vapors into the metallic bath thereby communicating the chamber with the metallic bath;

ceasing rotation of the ladle;

opening the lid to deslag the metallic bath; and closing the lid to case or transfer the metallic bath.

5. A device for treatment of a metallic bath by means of at least one treating material having a capability to generate gases or vapors when heated by the metallic bath, comprising:

a ladle having a pouring spout and a closing lid;

a chamber formed in a bottom portion of said ladle, said chamber enclosed by the metallic bath poured into the ladle, said chamber for receiving the treating material and holding the developed vapors or gases; and at least one release conduit passing from an upper portion of said chamber to end within the ladle, each said at least one release conduit being closed by a plug for providing a controlled opening of said release conduit.

6. The device according to claim 5, wherein said chamber is provided with an entrance proximate a bottom of said ladle, and a ceiling defining the upper portion further removed from said bottom of said ladle, the release conduit rising from the ceiling of said chamber.

7. The device according to claim 6, wherein said chamber having said entrance proximate the bottom of the ladle has an outer side of said chamber rising with an arched slope from said entrance towards an outer part of the ladle.

8. The device according to claim 6, wherein said chamber having said entrance level proximate the bottom of the ladle and sloping toward an outer part of the ladle, said chamber rising with an arched sloped from said entrance towards a longitudinal axis of the ladle.

9. The device according to claim 7, wherein said chamber is formed by removeable and interchangeable elements, mounted inside the ladle.

10. The device according to claim 5, wherein said closing lid is associated with said pouring spout and said closing lid may be opened and closed when required and can hold the treating material to be introduced into the ladle.

11. The device according to claim 5, wherein the ladle is rotatable and tiltable.

12. The device according to claim 5, wherein the ladle is movably mounted on a trolley structure.

13. A method for the treatment in a ladle of a liquid, metallic bath with a volatile, vaporizable treating material, comprising the steps of:

providing in a bottom portion of said ladle a chamber comprising an annular space rising from a bottom portion of said chamber, with a ceiling of the annular space having at least one downwardly extending aperture connected to at least one upwardly extending aperture, and the upwardly extending aperture containing a removable plug;

loading said treating material in the annular space;

pouring a molten metal into said ladle to form the liquid, metallic bath surrounding said chamber and having a first liquid level within the bottom portion of the annular space to form a vapor space surrounding said treating material between the ceiling and the first liquid level;

indirectly heating said treating material to form a vaporized treating material by the radiation of heat from said liquid bath into the vapor space;

retaining said vaporized treating material in the vapor space until said liquid bath reaches a second liquid level above said chamber; and removing the plug to permit said vaporized treating material to flow from the annular space into said liquid bath.

14. Method according to claim 13, wherein said ladle is rotatable.

* * * * *